US005509821A

United States Patent [19]

Small et al.

[11] Patent Number: 5,509,821

[45] Date of Patent: Apr. 23, 1996

[54] D-SUB CONNECTOR

[75] Inventors: Robert W. Small, Courtice; John P. van den Enden, Oshawa, both of Canada

[73] Assignee: ITT Corporation, New York, N.Y.

[21] Appl. No.: 338,927

[22] Filed: Nov. 14, 1994

[51] Int. Cl.[6] ..... H01R 13/52; H01R 17/04

[52] U.S. Cl. ..... 439/272; 439/578; 439/589

[58] Field of Search ..... 439/607, 608, 439/620, 587, 589, 272, 278, 578, 609, 610, 95, 108

[56] References Cited

U.S. PATENT DOCUMENTS

| | | | |
|---|---|---|---|
| 2,450,528 | 10/1948 | Sprigg | 174/77 |
| 3,290,639 | 12/1966 | Driemeyer | 339/94 |
| 3,569,915 | 3/1971 | Sorensen | 339/143 |
| 3,670,292 | 6/1972 | Tracy | 339/143 |
| 3,721,943 | 3/1973 | Curr | 339/94 |
| 3,790,858 | 2/1974 | Brancaleone et al. | 317/99 |
| 3,825,874 | 7/1974 | Peverill | 339/14 |
| 3,840,841 | 10/1974 | Clark | 339/147 |
| 3,963,297 | 6/1976 | Panek et al. | 339/94 |
| 4,126,370 | 11/1978 | Nijman | 339/143 |
| 4,402,566 | 9/1983 | Powell et al. | 339/103 |
| 4,761,147 | 8/1988 | Gauthier | 439/607 |
| 4,797,122 | 1/1989 | Kuboi et al. | 439/589 |
| 4,808,115 | 2/1989 | Norton et al. | 439/79 |
| 4,941,847 | 7/1990 | Welsh | 439/595 |
| 4,990,104 | 2/1991 | Schieferly | 439/578 |
| 5,192,216 | 3/1993 | Knauber et al. | 439/108 |
| 5,209,677 | 5/1993 | Bricaud | 439/607 |
| 5,257,949 | 11/1993 | Paulus | 439/620 |

FOREIGN PATENT DOCUMENTS

| | | | |
|---|---|---|---|
| 288992 | 11/1988 | European Pat. Off. | 439/589 |

*Primary Examiner*—Gary F. Paumen

*Attorney, Agent, or Firm*—Freilich Hornbaker Rosen

[57] ABSTRACT

A connector is described which provides moisture proof sealing and electrical grounding of selected contacts, especially for coaxial contact devices. The connector includes a conductive shell assembly (20, FIG. 4) with a rear wall (40) that has a large opening (42) therein. An insulator device (50) lies in the shell assembly and at least one coaxial contact device (52) lies in the insulator device. A ground plane (60) formed by a sheet of electrically conductive material has an outer portion (62) trapped between the insulator device and the rear wall of the shell assembly, and has an inner portion (63) that directly engages the outer contact of the coaxial contact device to ground it. The shell assembly includes front and rear tubular shell parts (32, 34), with the tubular rear shell part having a greater inside width and length than that of the front tubular shell part. The insulator device includes a front insulator (80) of elastomeric material having a peripheral portion (84) that is deformed rearwardly and radially inwardly by the rear end (86) of the front tubular shell part.

7 Claims, 2 Drawing Sheets

FIG. 5
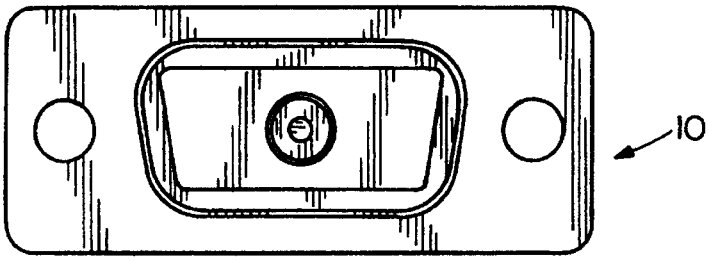
FIG. 6
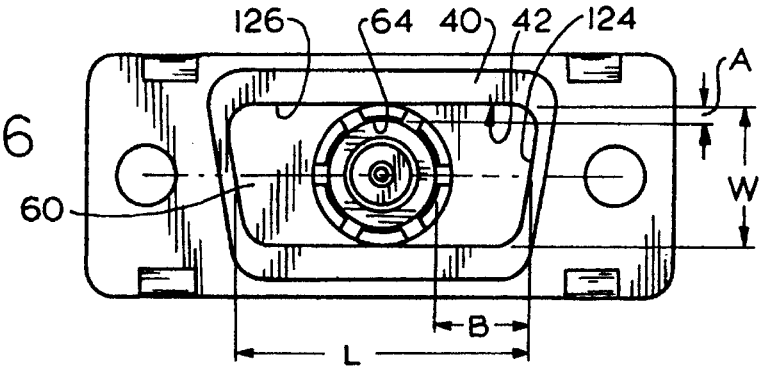
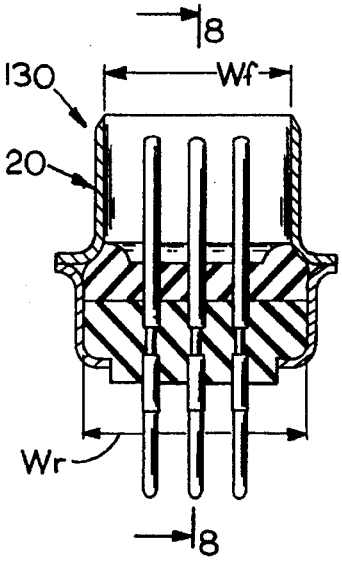
FIG. 7
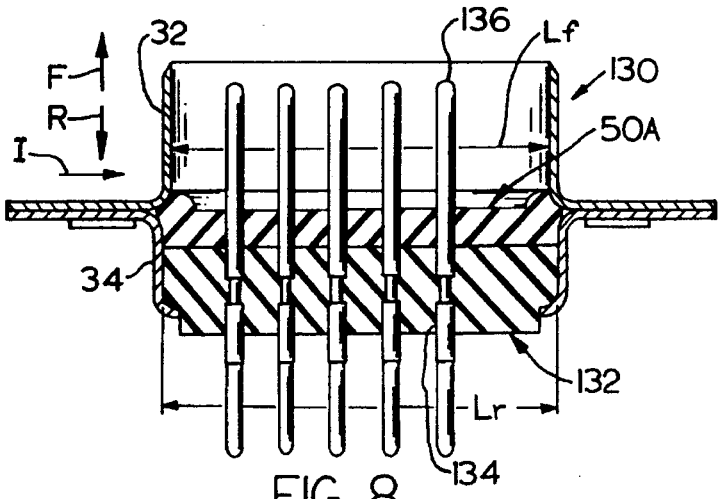
FIG. 8
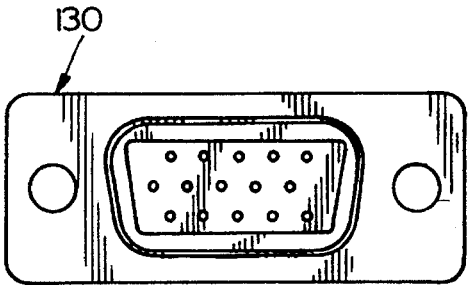
FIG. 9
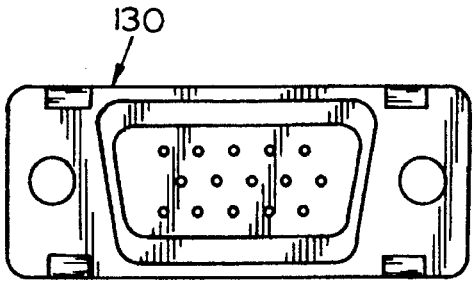
FIG. 10

D-SUB CONNECTOR

DESCRIPTION OF THE PRIOR ART

A common type of connector is a D-subminiature connector that includes front and rear shell parts with facewise adjacent plates that are fastened together and with tubular parts extending forwardly and rearwardly from the plates. An insulator device lies within the shell assembly, usually in the tubular rear part, and one or more contact devices lie within the insulator device. Some contact devices have regions that must be electrically grounded by connection to the shell assembly, such as the outer contact of a coaxial contact device. Prior connectors have used a ground plane formed by a sheet of conductive material sandwiched between two relatively rigid layers of the insulator device. It is difficult to use such a sandwiched ground plane where the contact device must be molded in place or securely bonded in place in a passage of the insulator device, as where the space between inner and outer coaxial contacts must be sealed against the entrance of moisture. A simple connector construction which utilized the prior art D-subminiature shell assembly and which provided a ground plane for grounding the outer coaxial contact while sealing to the contact, would be of value.

The insulator device of the common D-subminiature connector, commonly includes an elastomeric seal in the form of a simple plate. A better elastomeric seal for a moisture-tight connector would be of value.

SUMMARY OF THE INVENTION

In accordance with one embodiment of the present invention, a connector is provided with a moisture-resistant seal in a relatively simple construction. The connector includes an electrically conductive shell assembly with a rear tubular part that ends in a rear wall that has an opening. The connector includes an insulator device lying in the shell assembly and a contact device lying in the insulator device and having a region that must be connected to the shell. In one example, the contact device is a coaxial contact device whose outer coaxial contact must be grounded to the grounded shell assembly. A ground plane formed by a sheet of electrically conductive material has an outer portion trapped between the insulator device and the rear wall of the shell assembly, and has an inner portion that directly engages the coaxial outer contact. This construction avoids the need for the ground plane and its deflectable hole walls to lie between layers of the insulator device.

The shell assembly includes front and rear shells with facewise adjacent plate parts and with tubular front and rear shell parts extending from the plate parts. The rear tubular shell part has a smaller inside width and length than the front tubular shell part. The insulator device includes a front insulator of elastomeric material and a rear insulator portion. The front insulator has a peripheral portion that is deformed in a rearward and radially inward direction by the rear end of the front tubular shell part. The peripheral portion of the front insulator is preferably in the form of a flange with a rounded front end projecting forwardly from a plate region of the front insulator.

The novel features of the invention are set forth with particularity in the appended claims. The invention will be best understood from the following description when read in conjunction with the accompanying drawings.

BRIEF DESCRIPTION OF THE DRAWINGS

FIG. 5 is a front elevation view of the connector of FIG. 1.

FIG. 6 is a rear elevation view of the connector of FIG. 2.

FIG. 7 is a sectional view of a connector constructed accordance with a second embodiment of the invention.

FIG. 8 is a sectional view taken on line 8—8 of FIG. 7.

FIG. 9 is a front elevation view of the connector of FIG. 7.

FIG. 10 is a rear elevation view of the connector of FIG. 7.

DESCRIPTION OF THE PREFERRED EMBODIMENTS

Figure 1:
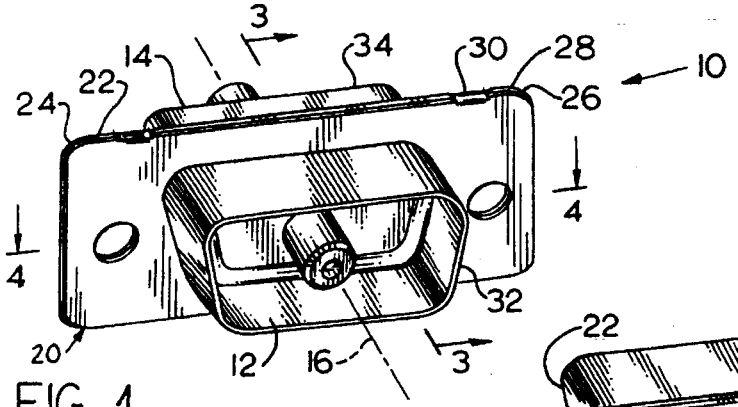
FIG. 1 is an isometric view showing primarily the front of a connector constructed in accordance with one embodiment of the present invention.
Figure 2:
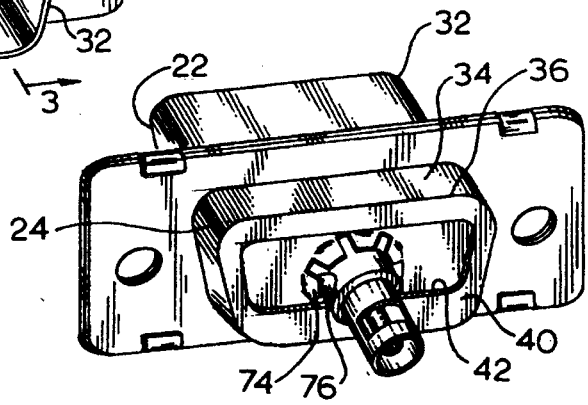
FIG. 2 is an isometric view showing primarily the rear of the connector of FIG. 1.

FIG. 1 illustrates a connector 10 which has front and rear ends 12, 14 spaced apart along an axis 16. The connector includes an electrically conductive shell assembly 20 of the type commonly used in D-subminiature connectors, which includes front and rear shells 22, 24. Each shell includes a plate part 26, 28, with the plate parts joined by tabs 30, and a tubular part 32, 34 extending away from the corresponding plate part. As shown in FIG. 2, the rear tubular part 34 has a rear end 36 that forms a rear wall 40 with an opening 42 therein.

Figure 4:
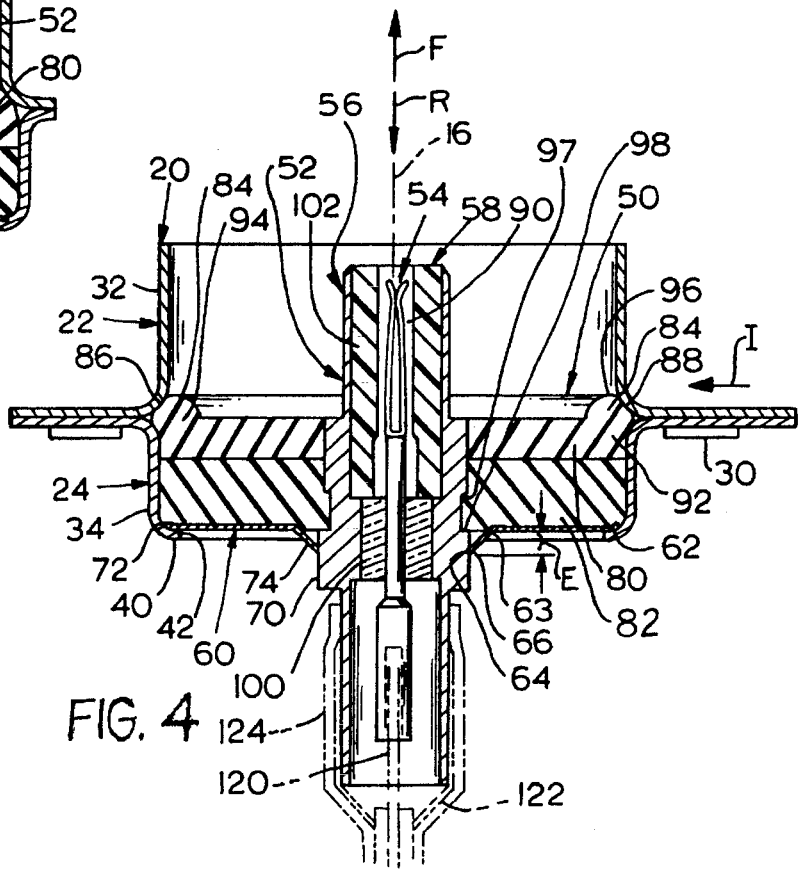
FIG. 4 is a sectional view taken on line 4—4 of FIG. 1.

As shown in FIG. 4, the connector includes an insulator device 50 lying in the shell assembly and at least one coaxial contact device 52 lying in the insulator device. The coaxial contact device includes coaxial inner and outer contacts 54, 56 and a dielectric separator 58 between them. The outer coaxial contact 56 is designed to be grounded through the shell assembly 20.

The coaxial outer contact 56 is electrically connected to the shell assembly by a ground plane 60 that is largely in the form of a sheet. The ground plane includes an outer portion 62 which is trapped between the insulator device 50 and the rear wall 40 of the rear shell 24. The ground plane includes an inner portion 63 with a hole 64, and with the walls 66 of the hole engaging a cylindrical portion 70 of the coaxial outer contact. The ground plane can be kept in place merely by the force of the insulator device 50 against the shell rear wall 40, although applicant prefers to bond the ground plane to the rear wall with electrically conductive adhesive, and to initially locate the ground plane by its peripheral edge 72 lying within the rear tubular part 32 of the rear shell.

The inner part 63 of the ground plane 60 is preferably in the form of individual fingers 74 (FIG. 2) formed between slots 76, although it is possible to use a sheet of electrically conductive elastomeric polymer for the ground plane. The axial distance E (FIG.4) occupied by the rearwardly deflected fingers, is a space lying rearward of the insulator device. As a result, the insulator device does not have to be provided with a large recess to accommodate such fingers. This helps provide a moisture-tight seal between the outer contact 56 and the insulator device.

The insulator device 50 includes a front insulator 80 of elastomeric material and a rear portion 82 which is preferably formed by a layer of hard rubber which is much stiffer than the material of the front insulator 80. The front insulator has a peripheral portion 84 that is deformed in a rearward direction R and a radially inward direction I (with respect to the axis 16) by the rear end 86 of the front tubular shell part 32. Such deformation not only holds the insulator device in place, but provides a moisture-resistant seal at the deformed insulator location 88. Although moisture (water) may pass around the periphery of the outer portion 62, migration of such moisture past the deformed location 88 is prevented by the pressure thereat. This helps prevent such moisture from reaching the gap 90 between the inner and outer coaxial contacts. Applicant prefers to form the front insulator 80 in the form of a plate that has an outer edge part 92, with a peripheral portion formed by a flange 94 having a rounded front end 96, with the forward, radially outward portion of the flange at 88 being deformed.

The outer contact 56 is anchored in the rear insulator portion 82 by the forwardly and rearwardly facing shoulders 97, 98 in the outer contact. The rear insulator portion 82 has a greater thickness than the front insulator 80, to stiffen the entire insulator device. The opposite ends (shown in FIG. 4) of the front insulator flange 96 projects radially outwardly (from axis 16) as well as forwardly. In a connector that applicant has constructed and tested, of the construction shown in FIGS. 1-4, the front insulator 80 was formed of rubber having a durometer of shore A 40 (i.e. relatively "soft"), while the rear portion 82 had a durometer of shore A 80 (relatively "hard" rubber).

The dielectric separator 58 of the coaxial contact device includes a glass seal 100 which is bonded to the inner and outer conductors and prevents the passage of moisture thereby. The dielectric separator also includes a part 102 of material such as TEFLON (a brand name of the Dupont Company for fluorocarbons), which has good dielectric characteristics for a coaxial connector.

Figure 3:
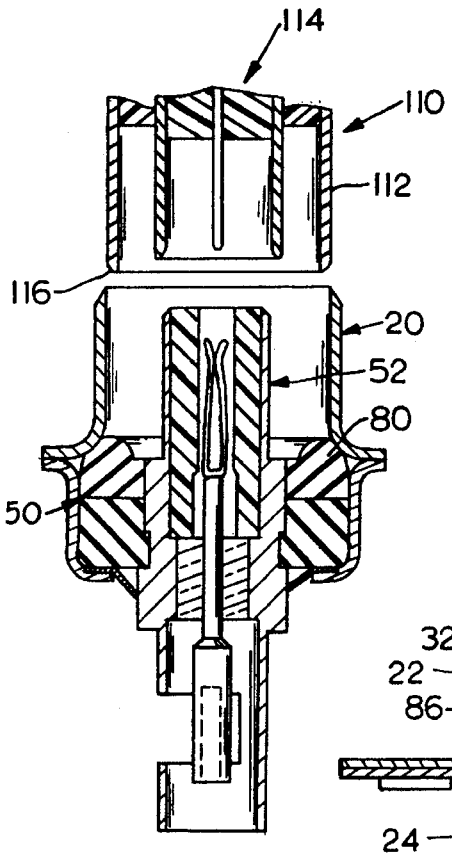
FIG. 3 is a sectional view taken on line 3—3 of FIG. 1, and showing a portion of a mating connector.

FIG. 3 indicates a mating connector device 110 which has a shell 112 that mates with the shell assembly 20, and which has a coaxial contact 114 which mates with the coaxial contact device 52. During mating, a front edge 116 of the mating connector engages the elastomeric front insulator 80 to form a seal therewith.

To assemble the connector 10, applicant places the coaxial contact device 52 within the insulator device 50. The elastomeric nature of the front and rear insulators enables the coaxial contact device to be forced into place, and it is preferably bonded in place. It also is possible to mold the two layers of the insulator device around the coaxial contact device. The ground plane 60 is placed at the rear of the rear shell 24, and the insulator device 50 with the coaxial contact device 52 therein is pushed rearwardly into place, with the cylindrical portion 70 of the outer contact deforming the fingers 74 of the ground plane so they extend a distance E which is greater than the thickness of the rear wall. Allowing for such large rearward projection of the ground plane fingers 74, allows for reliable contact. The ground plane 60 as well as the insulator device 50 can be bonded in place. Thereafter, the front shell 22 is positioned as shown, and the tabs 30 are folded over to lock the plate parts of the shells together.

FIG. 4 indicates that a coaxial cable can be terminated to the coaxial contact device by inserting the inner conductor 120 of the cable into the rear of the inner contact 54 and crimping the inner contact and/or soldering the conductor in place. A metallic braiding 122 of the cable is placed around the rear of the outer contact 56. A shrink sleeve 124 is placed over the termination and is heated to shrink it to the indicated configuration.

FIG. 6 shows that the opening 42 in the rear wall 40 has a greater length L than its width W. This results in an average lengthwise overhang length B (between the hole 64 and an end opening edge 124) being a plurality of times greater than the overhang A between the walls of the hole 64 and a side opening edge 126. The large size of the opening 42 permits the shell assembly to be used for connectors that have multiple contacts, wherein a large area of the opening is required to accommodate such contacts. Still, a small overhang A at the sides of the opening assure that the ground plane 60 will not be extruded through the opening when the coaxial device is inserted therethrough.

FIGS. 7–10 illustrate another connector 130 with a shell assembly 20 that is identical to the shell assembly of FIGS. 1–6. The connector 130 includes an insulator device 132 that is identical to the insulator device 50 of FIG. 4, except that it includes passages 134 for holding a plurality of single-conductor contacts 136. The width Wr and length Lr of the rear tubular part 34, is greater than the width Wf and length Lf of the front tubular part 32, which results in capture of the insulator device 50A.

Thus, the invention provides a connector with moisture-resistant sealing, which is of relatively simple construction. The connector can include a shell assembly of the type commonly used for D-subminiature connectors, which includes front and rear shells with tubular parts and with plate portions fastened facewise together. Where a contact device has a portion that must be grounded by connection to the shell, this can be accomplished by a ground plane whose peripheral portion is sandwiched between a rear wall of the shell and an insulator device. The ground plane can have a hole with hole walls that are rearwardly deflected, without requiring a clearance space in the insulator device to accommodate such deflected hole walls, which simplifies manufacture of the insulation device in a manner that assures moisture-resistant sealing to the contact device. The insulator device preferably includes a front insulator of soft elastomeric material (preferably a durometer of less than 60) that has a peripheral portion that is deformed in rearward and radially inward directions by the rear end of the front tubular part of the front shell, to form a moisture-resistant seal thereat.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector which has an axis extending in forward and rearward directions and which has an electrically conductive shell assembly with a rear tubular part having a rear end that forms a rear wall having an opening, said connector including an insulator device lying in said shell assembly and at least one coaxial contact device lying in said insulator device, said coaxial contact device including coaxial inner and outer contacts and a dielectric separator between them, wherein said coaxial outer contact is electrically connected to said shell assembly, characterized by:

a ground plane formed by a sheet of electrically conductive material, said ground plane having an outer portion trapped between and contacting both said insulator device and said rear wall and having an inner portion that directly engages said coaxial outer contact.

2. The connector described in claim 1 wherein:

said outer coaxial contact has a cylindrical portion that lies immediately rearward of said rear wall and which is engaged by said ground plane;

said opening in said rear wall has a width (W) and has a length (L), in directions that are perpendicular to said axis, with said length being greater than said width, with said ground plane sheet having a hole centered on said axis, with said sheet having a smaller overhang (A) along the direction of said width than its overhang (B) along the direction of said length.

3. The connector described in claim 2 wherein:

the overhang (A) in said width direction, between said outer coaxial contact cylindrical portion and the walls of said opening in said rear wall, is at least twice the overhang (B), in said height direction, between said outer coaxial contact cylindrical portion and the walls of said hole in said rear wall.

4. The connector described in claim 1 wherein:

said shell assembly includes front and rear shells with facewise adjacent plate parts and with tubular shell parts extending respectively forward and rearward of their plate parts;

said shell assembly has width and length dimension that are each perpendicular to said axis and to each other;

the front of said rear tubular shell part has an inside of greater width (Wr) and length (Lr) than the width (Wf) and length (Lf), respectively, of the inside of the rear end of said front tubular shell part;

said insulator device includes a front insulator of elastomeric material and a rear insulator portion, with said front insulator having a peripheral portion that is deformed in a rearward and radially inward direction by the rear end of said front tubular shell part.

5. A method for assembling a connector which includes an electrically conductive shell assembly that includes a shell rear wall with an opening therein, an insulator for lying in said shell, at least one contact device lying in said insulator and having a contact outer surface region that is to be electrically connected to said shell assembly, and a sheet like ground plane with a hole for connecting said contact outer surface region to said shell, comprising:

placing said ground plane between and in contact with both said insulator and said rear wall, to trap said ground plane in place, and projecting said contact partially through said hole in said ground plane until walls of said hole engage said contact outer surface region.

6. The method described in claim 5 wherein:

said step of projecting comprises projecting said contact outer surface region in a rearward direction through said hole to deflect said hole walls rearwardly to a rearward position at which said hole walls project rearwardly through said opening in said shell rear wall.

7. A connector which has an axis extending in forward and rearward directions and which has width and length dimensions that are perpendicular to each other and to said axis, said connector including a shell assembly having front and rear shells with facewise adjacent plate parts, said front and rear shells having front and rear tubular shell parts with said rear tubular part having a front end of greater inside width and length than that of said rear end of said front tubular part, and said connector including an insulator device lying in said shell assembly and at least one contact device lying in said insulator device, characterized by:

said insulator device includes a front insulator of elastomeric material and a rear portion, said front insulator having a peripheral portion that is deformed in rearward and radially inward directions by the rear end of said front tubular part of said front shell;

said rear portion comprises a rear insulator of elastomeric material of greater durometer and greater average thickness than that of said front insulator, with said at least one contact device anchored in said rear insulator;

said at least one contact device forming forwardly and rearwardly facing shoulders that abut said elastomeric rear insulator.

* * * * *